US006536225B1

(12) United States Patent
Yajima

(10) Patent No.: US 6,536,225 B1
(45) Date of Patent: Mar. 25, 2003

(54) AIR CONDITIONER

(75) Inventor: Ryuzaburo Yajima, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 09/914,589

(22) Filed: Aug. 30, 2001

(30) Foreign Application Priority Data

Mar. 2, 1999 (JP) ..... 11-54227

(51) Int. Cl.[7] ..... F25D 17/04; F25B 33/00
(52) U.S. Cl. ..... 62/407; 62/498
(58) Field of Search ..... 62/407, 410, 411, 62/404, 419, 259.1, 498, 149, 129, 125, 126

(56) References Cited

U.S. PATENT DOCUMENTS 5,918,475 A * 7/1999 Sakakibara et al. ..... 62/126 X
6,085,531 A * 7/2000 Numoto et al. ..... 62/149

FOREIGN PATENT DOCUMENTS

JP 9-324928 12/1997

OTHER PUBLICATIONS

English Translation of the International Preliminary Examination Report issued for the PCT application (PCT/JP00/01212).

* cited by examiner

*Primary Examiner*—Chen-Wen Jiang
(74) *Attorney, Agent, or Firm*—Nixon Peabody LLP; Donald R. Studebaker

(57) ABSTRACT

A refrigerant circuit (20) in a casing (11) is charged with a slightly flammable R3 refrigerant whose specific gravity is greater than that of air. The inside of the casing (11) is zoned into a utilization side air passageway (35) and a heat source side air passageway (31). An evaporator (24) and a condenser (22) are disposed in the utilization side air passageway (35) and in the heat source side air passageway (31), respectively. The utilization side air passageway (35) communicates with the inside of a room through ducts (17, 18). Formed in a lower potion of the casing (11) is a slit-like opening portion (40). The opening portion (40) opens to a lower portion of the utilization side air passageway (35). Leaking refrigerant from the refrigerant circuit (20) travels downwardly by gravity and is automatically discharged, through the opening portion (40), to outside the casing (11).

14 Claims, 6 Drawing Sheets

AIR CONDITIONER

TECHNICAL FIELD

The present invention relates to an air-conditioning apparatus with a refrigerant circuit. This invention is directed more specifically to providing means for prevention of harmful effects due to refrigerant leakage.

BACKGROUND ART

Air-conditioning apparatus that perform a refrigerating cycle by refrigerant circulation in a refrigerant circuit have long been known. Besides, there is known another air-conditioning apparatus of the type that its every constitutional equipment such as a refrigerant circuit, a fan, and the like is housed within an outdoor casing and the outdoor casing and an indoor space are connected together by a duct for supplying conditioned-air into the room. An example of such a type of air-conditioning apparatus is an air-conditioning apparatus of the so-called roof top type. In that air-conditioning apparatus, its casing is placed on a roof of for example a house and duct connected to a room.

PROBLEMS THAT THE INVENTION INTENDS TO SOLVE

Since CFC, a substance which has been used as a refrigerant for air conditioners and refrigerators, destroys the Earth's ozone layer, there have been attempts to replace CFC refrigerants with ozone-friendly refrigerants. These CFC replacements are HFC substances such as R32, R152a, and the like. However, these substances are slightly flammable. If such a flammable substance is employed as a refrigerant for air-conditioning apparatus with an outdoor refrigerant circuit and if there occurs refrigerant leakage from the refrigerant circuit, this introduces the danger that leaking refrigerant flows into a room by way of a duct. Such refrigerant leakage may cause serious hazards. For example if leaking refrigerant is ignited in the room, this may cause a fire.

On the other hand, R407C and R410A, which are combined refrigerants containing R32, have been proposed. These combined refrigerants contain R125 which is an ignition suppressant and their flammability is lower in comparison with sole R32. However, because of the mixing of R125, the global warming potential (GWP) (the ratio with respect to $CO_2$) becomes relatively high. More specifically, the GWPs of R407C, R410A, R404A, and R22 are 1530, 1730, 3260, and 1500, respectively. On the other hand, since R32 and R152a have molecules that contain a relatively larger amount of hydrogen, they are easily decomposed in the atmosphere and have low GWP. Because of this, when taking into consideration the GWP, it is preferable that R32 or the like be used alone as a refrigerant.

As the aforesaid replacement for CFC, hydrocarbon refrigerants such as propane and butane have been known, but these hydrocarbon refrigerants are highly flammable. Therefore, if a refrigerant of the above flammable type is used in the foregoing air-conditioning apparatus, this may cause a fire hazard not only when the refrigerant leaks and flows into a room, but also even when the leaking refrigerant stays within the casing. That is, since these refrigerants are highly flammable, there is the danger that they are ignited by a slight spark occurring at a relay contact point in an electric system of the air-conditioning apparatus, thereby causing a fire hazard.

Further, even when a typical R22 substance or the like is used as a refrigerant, the possibility of accidents such as suffocation due to a lack of oxygen exists if leaking refrigerant flows into a room.

Bearing in mind the above-described problems, the present invention was made. Accordingly, an object of the present invention is to provide means for preventing the occurrence of harmful effects due to refrigerant leakage in air-conditioning apparatus with an outdoor refrigerant circuit.

DISCLOSURE OF THE INVENTION

In the present invention, leaking refrigerant from the refrigerant circuit is assuredly discharged into the open air.

The present invention provides a first solution means intended for an air-conditioning apparatus including a refrigerant circuit (20) charged with refrigerant. In this air-conditioning apparatus, a utilization side air passageway (35) in which a utilization side heat exchanger (24) for the refrigerant circuit (20) is disposed is divided into zones, the utilization side air passageway (35) being in communication with the inside of a room. In addition, an opening portion (40), which opens to the utilization side air passageway (35) to allow the utilization side air passageway (35) to communicate with the outside of the room so that refrigerant leaking from the refrigerant circuit (20) into the utilization side air passageway (35) is at least discharged from the opening portion (40) to outside the room.

The present invention provides a second solution means intended for an air-conditioning apparatus comprising an outdoor casing (11) for housing therein a refrigerant circuit (20) charged with refrigerant. In this air-conditioning apparatus, a utilization side air passageway (35) in which a utilization side heat exchanger (24) for the refrigerant circuit (20) is disposed and a heat source side air passageway (31) in which a heat source side heat exchanger (22) for the refrigerant circuit (20) is disposed are formed in the casing (11), these passageways (35) and (31) being in communication with the inside and the outside of a room, respectively. In addition, an opening portion (40) allowing the utilization side air passageway (35) to communicate with the outside of the casing (11) is formed in the casing (11).

The present invention provides a third solution means according to the first or second solution means in which the refrigerant of the refrigerant circuit (20) comprises a substance whose atmospheric specific gravity is greater than that of air and the opening portion (40) is so formed as to open to a lower portion of the utilization side air passageway (35).

The present invention provides a fourth solution means according to the third solution means wherein the opening portion (40) is so formed as to open to the utilization side air passageway (35) at a level lower than one-third of the overall height of the utilization side air passageway (35) from the bottom of the utilization side air passageway (35).

The present invention provides a fifth solution means according to the first or second solution means wherein the refrigerant of the refrigerant circuit (20) comprises a substance whose atmospheric specific gravity is smaller than that of air and the opening portion (40) is so formed as to open to an upper portion of the utilization side air passageway (35).

The present invention provides a sixth solution means according to the fifth solution means wherein the opening portion (40) is so formed as to open at a level higher than two-thirds of the overall height of the utilization side air passageway (35) from the bottom of the utilization side air passageway (35).

The present invention provides a seventh solution means according to the second solution means wherein the refrigerant of the refrigerant circuit (20) comprises a substance whose atmospheric specific gravity is greater than that of air, wherein an air suction opening (38) is formed in a lateral portion of the casing (11), thereby allowing the utilization side air passageway (35) to communicate with the inside of the room through a duct (17) connected to the air suction opening (38), and wherein the opening portion (40) is so formed as to open to the utilization side air passageway (35) at a level lower than the uppermost portion of the air suction opening (38).

The present invention provides an eighth solution means according to the second solution means wherein the refrigerant of the refrigerant circuit (20) comprises a substance whose atmospheric specific gravity is smaller than that of air, wherein an air suction opening (38) is formed in a lateral portion of the casing (11), thereby allowing the utilization side air passageway (35) to communicate with the inside of the room through a duct (17) connected to the air suction opening (38), and wherein the opening portion (40) is so formed as to open to the utilization side air passageway (35) at a level higher than the lowermost portion of the air suction opening (38).

The present invention provides a ninth solution means according to any one of the first to eighth solution means wherein the opening portion (40) is so formed as to open to both upstream and downstream sides of the utilization side heat exchanger (24) in the utilization side air passageway (35).

The present invention provides a tenth solution means according to the second solution means wherein an air suction opening (38) is formed in the casing (11), thereby allowing the utilization side air passageway (35) to communicate with the inside of the room through a duct (17) connected to the air suction opening (38) and wherein a baffle plate (41) is positioned in the air suction opening (38) so that refrigerant leaking from the refrigerant circuit (20) into the utilization side air passageway (35) is prevented from flowing into the inside of the room.

The present invention provides an eleventh solution means according to the second solution means wherein the refrigerant of the refrigerant circuit (20) comprises a substance whose atmospheric specific gravity is greater than that of air, wherein the utilization side air passageway (35) communicates with the inside of the room through a duct (17) connected to a bottom portion of the casing (11), and wherein the duct 17 is connected to the casing (11) so that one end of the duct (17) projects into the utilization side air passageway (35).

The present invention provides a twelfth solution means according to the second solution means wherein the utilization side air passageway (35) in which a utilization side blower means (12) is disposed is zoned into an upstream passageway (36) on the upstream side of the utilization side blower means (12) and a downstream passageway (37) on the downstream side of the utilization side blower means (12), wherein the refrigerant circuit (20) is so arranged in the upstream passageway (36) and in the heat source side air passageway (31) as to detour the downstream passageway (37), and wherein the opening portion (40) is so formed as to allow the upstream passageway (36) of the utilization side air passageway (35) to communicate with the outside of the casing (11).

The present invention provides a thirteenth solution means according to the first or second solution means wherein a detection means for detecting the presence or absence of a refrigerant leak from the refrigerant circuit (20), an exhaust blower means for discharging refrigerant in the utilization side air passageway (35) from the opening portion (40), and a control means for performing control so that, upon detection of a refrigerant leak by the detection means, the blower means is brought into operation, are provided.

The present invention provides a fourteenth solution means intended for an air-conditioning apparatus comprising an outdoor casing (11) for housing a refrigerant circuit (20) charged with refrigerant. In this air-conditioning apparatus, a utilization side air passageway (35) in which a utilization side heat exchanger (24) for the refrigerant circuit (20) is disposed and a heat source side air passageway (31) in which a heat source side heat exchanger (22) for the refrigerant circuit (20) is disposed are formed in the casing (11), these passageways (35) and (31) being in communication with the inside and the outside of a room, respectively. In addition, the air-conditioning apparatus further comprises a heat source side blower means (13) disposed in the heat source side air passageway (31), a detection means for detecting the presence or absence of a refrigerant leak from the refrigerant circuit (20), a switching means for performing switching so that the connection of the utilization side air passageway (35) and the heat source side air passageway (31) switches between a communicated state and a disconnected state, and a control means for performing control so that, upon detection of a refrigerant leak by the detection means, the utilization side air passageway (35) and the heat source side air passageway (31) are brought into communication with each other and the heat source side blower means (13) is brought into operation.

The present invention provides a fifteenth solution means intended for an air-conditioning apparatus comprising an outdoor casing (11) for housing a refrigerant circuit (20) charged with flammable refrigerant. In this air-conditioning apparatus, a utilization side air passageway (35) in which a utilization side heat exchanger (24) for the refrigerant circuit (20) is disposed and a heat source side air passageway (31) in which a heat source side heat exchanger (22) for the refrigerant circuit (20) is disposed are formed in the casing (11), these passageways (35) and (31) being in communication with the inside and the outside of a room, respectively. In addition, the air-conditioning apparatus further comprises a heat source side blower means (13) disposed in the heat source side air passageway (31), a detection means for detecting the presence or absence of a refrigerant leak from the refrigerant circuit (20), and a control means for performing control so that, upon detection of a refrigerant leak by the detection means, the heat source side blower means (13) is brought into operation.

The present invention provides a sixteenth solution means according to any one of the first to fourteenth solution means wherein the refrigerant of the refrigerant circuit (20) comprises a flammable substance.

Action

In the first solution means, refrigerant circulates in the refrigerant circuit (20), whereby a refrigerating cycle is performed. Indoor air is drawn into the utilization side air passageway (35). The drawn air is cooled by heat exchange with refrigerant in the utilization side heat exchanger (24) and thereafter returned to the room. An arrangement may be made in which a four-way selector valve or the like is provided in the refrigerant circuit (20) to make the direction of refrigerant circulation reversible to permit heat pump operation.

If there occurs refrigerant leakage from the refrigerant circuit (20) during shutdown, leaking refrigerant will flow into the utilization side air passageway (35). However, the leaking refrigerant, after passing through the opening portion (40), is purged from the utilization side air passageway (35) to outside the room. At that time, it may be arranged such that leaking refrigerant is purged from the opening portion (40) automatically or forcedly. Therefore, the leaking refrigerant will not flow into the room.

In the second solution means, refrigerant circulates in the refrigerant circuit (20), whereby a refrigerating cycle is performed. An arrangement may be made in which a four-way selector valve or the like is provided in the refrigerant circuit (20) to make the direction of refrigerant circulation reversible to permit heat pump operation. Indoor air is drawn into the utilization side air passageway (35). The drawn air is cooled by heat exchange with refrigerant in the utilization side heat exchanger (24) and thereafter returned to the room. On the other hand, outdoor air is drawn into the heat source side air passageway (31). The drawn air is cooled by heat exchange with refrigerant in the heat source side heat exchanger (22) and thereafter returned to outside the room. In this way, air-conditioning operation of the air-conditioning apparatus is performed.

If there occurs refrigerant leakage from the refrigerant circuit (20) during shutdown, leaking refrigerant will flow into the utilization side air passageway (35). However, the leaking refrigerant, after passing through the opening portion (40) formed in the casing (11), is purged to outside the casing (11). At that time, it may be arranged such that leaking refrigerant is purged from the opening portion (40) automatically or forcedly. Therefore, the leaking refrigerant will neither stay in the casing (11) nor flow into the room.

In the third solution means, since the specific gravity of the refrigerant used is greater than that of air, leaking refrigerant from the refrigerant circuit (20) stays in the lower area of the utilization side air passageway (35). However, since the opening portion (40) opens to a lower portion of the utilization side air passageway (35), the leaking refrigerant is automatically purged from the opening portion (40) to outside the room by gravity.

In the fourth solution means, in the utilization side air passage way (35) the opening portion (40) opens to the utilization side air passageway (35) at a level between the bottom of the utilization side air passageway (35) and a position situated above the bottom of the utilization side air passageway (35) by one-third of the overall height of the utilization side air passageway (35).

In the fifth solution means, since the specific gravity of the refrigerant used is smaller than that of air, leaking refrigerant will stay in the upper area of the utilization side air passageway (35). However, since the opening portion (40) opens to an upper portion of the utilization side air passageway (35), the leaking refrigerant is automatically purged from the opening portion (40) to outside the room by buoyancy.

In the sixth solution means, the opening portion (40) opens to the utilization side air passage way (35) at a level higher than two-thirds of the overall height of the utilization side air passageway (35) from the bottom thereof.

In the seventh or eighth solution means, the air suction opening (38) is formed in a lateral portion of the casing (11) and the duct (17) is connected to the air suction opening (38). The duct (17) extends into the room, and the utilization side air passageway (35) is brought into communication with an indoor space through the duct (17).

Further, in the seventh solution means, since the specific gravity of the refrigerant used is greater than that of air, leaking refrigerant from the refrigerant circuit (20) travels downwardly from the refrigerant circuit (20). The opening portion (40) opens to the utilization side air passageway (35) at a level lower than the uppermost portion of the air suction opening (38). As a result of such arrangement, the leaking refrigerant from the refrigerant circuit (20) will neither stay in the duct (17) nor flow into the room through the duct (17). That is, the leaking refrigerant is purged to outside the casing (11) from the opening portion (40).

Further, in the eighth solution means, since the specific gravity of the refrigerant used is smaller than that of air, leaking refrigerant from the refrigerant circuit (20) travels upwardly from the refrigerant circuit (20). The opening portion (40) opens to the utilization side air passageway (35) at a level higher than the lowermost portion of the air suction opening (38). As a result of such arrangement, the leaking refrigerant from the refrigerant circuit (20) will neither stay within the duct (17) nor flow into the room through the duct (17). That is, the leaking refrigerant is purged to outside the casing (11) from the opening portion (40).

In the ninth solution means, the opening portion (40) opens to both upstream and downstream sides of the utilization side heat exchanger (24) in the utilization side air passageway (35).

In the tenth solution means, the air suction opening (38) is formed in the casing (11), and the duct (17) is connected to the air suction opening (38). The duct (17) extends to the room and the utilization side air passageway (35) is brought into communication with an indoor space through the duct (17). The specified baffle plate (41) is positioned in the air suction opening (38). Because of such arrangement, leaking refrigerant from the refrigerant circuit (20) is obstructed by the baffle plate (41), in other words, the leaking refrigerant will not flow, from the air suction opening (38), into the room by way of the duct (17). That is, the leaking refrigerant is purged from the opening portion (40) to outside the casing (11).

In the eleventh solution means, the specific gravity of the refrigerant used is greater than that of air, so that leaking refrigerant from the refrigerant circuit (20) travels downwardly from the refrigerant circuit (20) and stays also in the lower area of the utilization side air passageway (35). The duct (17) is connected to a bottom portion of the casing (11) with one end thereof projecting into the utilization side air passageway (35). Because of such arrangement, the refrigerant staying in the bottom area of the utilization side air passageway (35) will flow neither into the duct (17) nor into the room through the duct (17).

In the twelfth solution means, the utilization side air passageway (35) is zoned into the upstream passageway (36) on the upstream side of the utilization side blower means (12) and the downstream passageway (37) on the downstream side. The refrigerant circuit (20) is so arranged as to detour the downstream passageway (37), in other words, the refrigerant circuit (20) is arranged only in the upstream passageway (36) and heat source side air passageway (31). If there occurs refrigerant leakage from the refrigerant circuit (20), leaking refrigerant flows only into the passageways (36) and (31). The leaking refrigerant will not flow into the downstream passageway (37), unless the utilization side blower means (12) is brought into operation. Because of this, the leaking refrigerant will not flow into the room from the downstream passageway (37). Further, since the heat source side air passageway (31) is in communication with the outside of the room, refrigerant flowing into the heat source side air passageway (31) is discharged to outside the casing (11), whereas refrigerant flowing into the upstream passageway (36) is discharged from the opening portion (40) to outside the casing (11).

In the thirteenth solution means, when there occurs refrigerant leakage from the refrigerant circuit (20), such a refrigerant leak is detected by the detection means. The control means performs control so that upon detection of a refrigerant leak by the detection means the exhaust blower means is brought into operation. Because of this, the leaking refrigerant is discharged from the opening portion (40) to outside the room.

In the fourteenth solution means, cooling operation of the air-conditioning apparatus is performed in the same way as the second solution means. At that time, outdoor air is drawn into the heat source side air passageway (31) by the operation of the heat source side blower means (13). The drawn air, after passing through the heat source side heat exchanger (22), is discharged. If the detection means detects refrigerant leakage during cooling operation shutdown, the control means performs control so that the switching means (43) switches and the heat source side blower means (13) is brought into operation. By virtue of such switching by the switching means (43), the utilization side air passageway (35) and the heat source side air passageway (31) are brought into communication with each other. The heat source side blower means (13) is brought into operation in such a communicated state, whereby refrigerant leaking from the refrigerant circuit (20) into the utilization side air passageway (35) is drawn by the heat source side blower means (13) and discharged to outside the casing (11).

In the fifteenth solution means, cooling operation of the air-conditioning apparatus is performed in the same way as the second solution means. At that time, outdoor air is drawn into the heat source side air passageway (31) by the operation of the heat source side blower means (13). The drawn air, after passing through the heat source side heat exchanger (22), is discharged. The refrigerant of the refrigerant circuit (20) comprises a flammable substance. There are example flammable substances which can be used as the refrigerant, namely, HFC substances such as R332 and R152*a*, combined refrigerants containing R32 et cetera, and hydrocarbons such as propane, butane, and isobutane. If the detection means detects a refrigerant leak during cooling operation shutdown, the heat source side blower means (13) is brought into operation. Because of this, refrigerant leaking from the refrigerant circuit (20) into the heat source side air passageway (31) is drawn by the heat source side blower means (13) and discharged to outside the casing (11).

In the sixteenth solution means, the refrigerant of the refrigerant circuit (20) comprises a flammable substance. There are example flammable substances which can be used as the refrigerant, namely, HFC substances such as R332 and R152a, combined refrigerants containing R32 et cetera, and hydrocarbons such as propane, butane, and isobutane.

Effects

In the fifteenth solution means, cooling operation of the air-conditioning apparatus is performed in the same way as the second solution means. At that time, outdoor air is drawn into the heat source side air passageway (31) by the operation of the heat source side blower means (13). The drawn air, after passing through the heat source side heat exchanger (22), is discharged. The refrigerant of the refrigerant circuit (20) comprises a flammable substance. There are example flammable substances which can be used as the refrigerant, namely, HFC substances such as R32 and R152a, combined refrigerants containing R32 et cetera, and hydrocarbons such as propane, butane, and isobutane. If the detection means detects a refrigerant leak during cooling operation shutdown, the heat source side blower means (13) is brought into operation. Because of this, refrigerant leaking from the refrigerant circuit (20) into the heat source side air passageway (31) is drawn by the heat source side blower means (13) and discharged to outside the casing (11).

In the sixteenth solution means, the refrigerant of the refrigerant circuit (20) comprises a flammable substance. There are example flammable substances which can be used as the refrigerant, namely, HFC substances such as R32 and R152a, combined refrigerants containing R32 et cetera, and hydrocarbon such as propane, butane, and isobutane.

As a result, even when flammable substances are used as a refrigerant for the refrigerant circuit (20), it is possible to prevent the refrigerant concentration from increasing in the air (in other words, the refrigerant is prevented from igniting) and it is also possible to avoid serious accidents such as a fire due to refrigerant leakage. And, it is possible to use, as a refrigerant, a substance of low GWP which does not destroy the Earth's ozone layer (although it exhibits flammability), while maintaining safety, and it is possible to suppress adverse global environmental effects.

Particularly, in accordance with the third to ninth solution means, since it is arranged such that the opening portion (40) opens to the utilization side air passageway (35) at a given level, leaking refrigerant from the refrigerant circuit (20) is automatically discharged from the opening portion (40) to outside the casing (11), thereby making it possible to prevent the leaking refrigerant from flowing into the room. As a result, the discharging of leaking refrigerant can be performed by providing only the opening portion (40), thereby making it possible to assuredly avoid the occurrence of accidents due to refrigerant leakage while keeping the structure simple.

Further, in accordance with the tenth to twelfth solution means, it is possible to assuredly prevent leaking refrigerant from the refrigerant circuit (20) from flowing into the room by the provision of the baffle plate (41), the structure of the duct (17), or the structure of the utilization side air passageway (35) and the arrangement of the refrigerant circuit (20). Because of this, it is possible to assuredly avoid the occurrence of accidents due to refrigerant leakage.

Furthermore, in accordance with the thirteenth solution means, leaking refrigerant from the opening portion (40) is forcedly discharged to outside the room by the exhaust blower means, so that it is possible to assuredly discharge leaking refrigerant to outside the casing (11), even during air-conditioning operation.

Further, in accordance with the fourteenth solution means, it is possible to forcedly discharge leaking refrigerant to outside the casing (11) by appropriating the heat source side blower means (13) of the heat source side air passageway (31).

Furthermore, in accordance with the fifteenth solution means, it is possible to assuredly discharge refrigerant leaking from the refrigerant circuit (20) to the heat source side air passageway (31), to outside the casing (11). The present solution means is particularly effective for cases in which highly flammable substances such as propane are used as a refrigerant for the refrigerant circuit (20). That is, since the heat source side air passageway (31) is in communication with the outside of the room, leaking refrigerant is unlikely to stay in the passageway (31); however, there still exists the possibility that such a highly flammable substance becomes ignited even when its amount is very small. On the other hand, in accordance with the present solution means, it is possible to assuredly prevent the occurrence of accidents such as a fire because leaking refrigerant is discharged out of the casing (11) by bringing the heat source side blower means (13) into operation.

BEST MODE FOR CARRYING OUT THE INVENTION

Hereinafter, embodiments of the present invention will be described with reference to the accompanying drawings.

First Embodiment of the Invention

Figure 1:
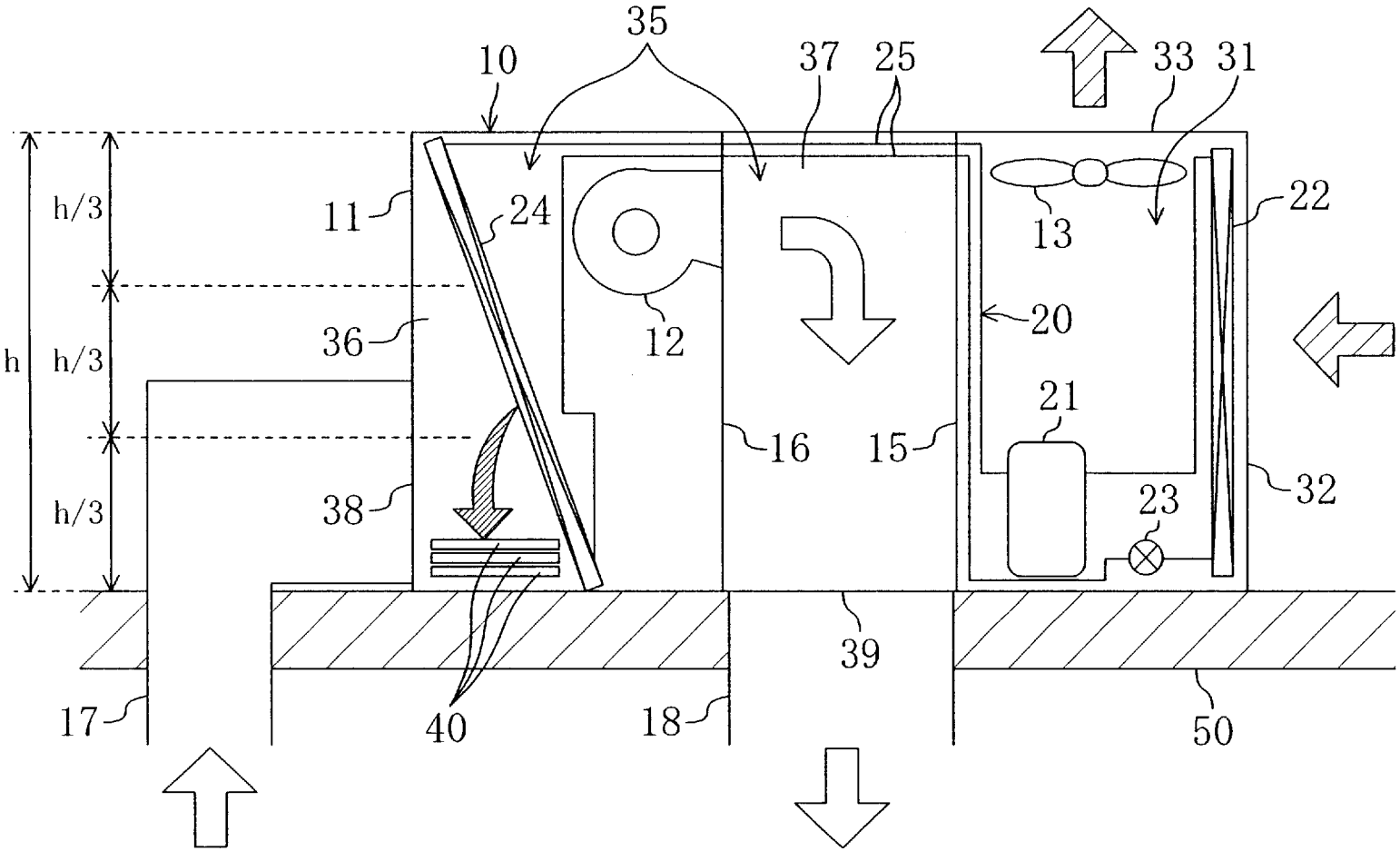
FIG. 1 is a schematic arrangement diagram of an air-conditioning apparatus according to a first embodiment of the present invention, when viewed from a side thereof.

As shown in FIG. 1, an air-conditioning apparatus of the present embodiment is of the so-called roof top type. A main body unit (10) of the air-conditioning apparatus is positioned on a roof (50) of a house or the like. The main body unit (10) comprises a casing (11) of rectangular parallelepiped shape. Housed in the casing (11) are a refrigerant circuit (20), an evaporator fan (12), and a condenser fan (13).

The refrigerant circuit (20) is formed by connecting in sequence a compressor (21), a condenser (22), an expansion valve (23), and an evaporator (24). Refrigerating cycle operation is performed by the circulation of refrigerant in the refrigerant circuit (20). Further, the condenser (22) comprises a heat source side heat exchanger. On the other hand, the evaporator (24) comprises a utilization side heat exchanger.

The refrigerant of the refrigerant circuit (20) is composed of R32. This R32 refrigerant is slightly flammable and its atmospheric specific gravity is greater than that of air. Alternatively, a combined refrigerant containing R32, which is flammable like sole R32, may be used. Further, likewise, an R152a refrigerant may be used alone, and an R152a-containing combined refrigerant may be used. Furthermore, flammable hydrocarbon refrigerants such as propane, butane, and isobutane may be used.

A bulkhead (15) is positioned in the casing (11), and the inside of the casing (11) is zoned by the bulkhead (15) into a heat source side air passageway (31) and a utilization side air passageway (35). An outside air inlet (32) and an outside air outlet (33) are formed in the casing (11). The heat source side air passageway (31) is brought into communication with the outside of the casing (11), i.e., with the outside of the room, through the outside air inlet (32) and the outside air outlet (33).

Disposed in the heat source side air passageway (31) are the compressor (21), the condenser (22), and the expansion valve (23) of the refrigerant circuit (20). Further, the condenser fan (13), which is a heat source side blower means, is positioned in the heat source side air passageway (31). The condenser (22) is disposed in a corresponding position with respect to the outside air inlet (32), and the condenser fan (13) is disposed in a corresponding position to the outside air outlet (33).

A bulkhead (16) is positioned in the casing (11), and the utilization side air passageway (35) is zoned by the bulkhead (16) into an upstream passageway (36) and a downstream passageway (37). Attached to the bulkhead (16) is the evaporator fan (12) which serves as a utilization side blower means. The upstream passageway (36) and the downstream passageway (37) are brought into communication with each other through the evaporation fan (12). That is, the upstream passageway (36) is positioned upstream of the evaporator fan (12) and the downstream passageway (37) is positioned downstream of the evaporator fan (12).

An air blowoff opening (39) is formed in a bottom portion of the casing (11). One end of a blowoff duct (18) is connected to the air blowoff opening (39). The blowoff duct (18) is so positioned as to pass through the roof (50) and opens, at the other end, to an indoor space. The downstream passageway (37) of the utilization side air passageway (35) is brought into communication with the indoor space through the air blowoff opening (39) and the blowoff duct (18).

An air suction opening (38) is formed in a lateral portion of the casing (11). One end of a suction duct (17) is connected to the air suction opening (38). This suction duct (17) is so positioned as to pass through the roof (50) and opens, at the other end, to the indoor space. The upstream passageway (36) of the utilization side air passageway (35) is brought into communication with the indoor space through the air suction opening (38) and the suction duct (17). Further, the evaporator (24) of the refrigerant circuit (20) is disposed in the upstream passageway (36) of the utilization air passageway (35).

An oblong, slit-like opening portion (40) is formed in a lower portion of the side of the casing (11). The opening portion (40) opens to the upstream passageway (36) of the utilization side air passageway (35) at a specified level. That is, the opening portion (40) opens to the upstream passageway (36) at a level lower than the uppermost portion of the air suction opening (38). It is more preferable that the opening portion (40) be opened at a level lower than one-third of the overall height (h) of the upstream passageway (36) in the height direction (i.e., at a level lower than h/3 from the bottom of the upstream passageway (36)). The upstream passageway (36) is brought into communication with the outside of the casing (11) through the opening portion (40).

Running Operation

Next, cooling operation of the air-conditioning apparatus will be described. In the cooling operation, the compressor (21), the evaporator fan (12), and the condenser fan (13) are brought into operation. When the compressor (21) operates, refrigerant circulates in the refrigerant circuit (20), whereby a refrigerating cycle operation is performed.

When the evaporation fan (12) operates, indoor air is drawn into the suction duct (17). The drawn air passes through the air suction, opening (38), enters the upstream passageway (36) of the utilization side air passageway (35), and is cooled by heat exchange with the refrigerant of the refrigerant circuit (20) in the evaporator (24). The cooled air passes through the evaporator fan (12), enters the downstream passageway (37), passes through the air blowoff opening (39) and the blowoff duct (18), and is supplied into the room.

When the condenser fan (13) operates, outdoor air is drawn into the heat source side air passageway (31) from the outside air inlet (32). The drawn air exchanges heat with the refrigerant of the refrigerant circuit (20) in the condenser (22). Because of this, the refrigerant of the refrigerant circuit (20) radiates heat to the air. Thereafter, the air flows in the heat source side air passageway (31) and is expelled from the outside air outlet (33) to outside the room.

During the cooling operation, the opening portion (40) acts as a fresh air intake opening. That is, when the evaporator fan (12) is in operation, outdoor air flows into the upstream passageway (36) from the opening portion (40). The outdoor air, after merging with indoor air from the suction duct (17), flows into the room through the blowoff duct (18).

If there occurs refrigerant leakage from the refrigerant circuit (20) during cooling operation shutdown, leaking refrigerant, i.e., R32, travels downwardly by gravity since the R32 refrigerant is lower in specific gravity than air. On the other hand, if there occurs refrigerant leakage from the evaporator (24) or from the refrigerant pipe (25), leaking refrigerant travels downwardly in the upstream passageway (36). Because of this, the refrigerant leaking into the upstream passageway (36), after passing through the opening portion (40) which opens to a lower portion of the upstream passageway (36), is discharged to outside the casing (11), in other words, the leaking refrigerant will not flow, through the suction duct (17), into the room.

Effects of the First Embodiment

In accordance with the first embodiment, even when there occurs refrigerant leakage from the refrigerant circuit (20), it is possible to prevent leaking refrigerant from flowing into the room. This assuredly avoids such a situation that refrigerant flows into the room and ignites there, therefore causing a fire hazard.

Furthermore, it is possible to assuredly discharge leaking refrigerant to outside the casing (11). Even for the case of flammable refrigerants, they will not catch fire, unless the mixing ratio of refrigerant to air, i.e., the refrigerant concentration in the air, increases to a certain extent. More specifically, for the case of R32, it will not catch fire, unless its concentration in the air exceeds 13%. In the present embodiment, it is possible to prevent the increase in refrigerant concentration in the casing (11) by discharging refrigerant to outside the casing (11). In addition, the refrigerant discharged to outside the casing (11) spreads into the open air, thereby preventing the increase in refrigerant concentration outside the casing (11). Because of this, it is possible to assuredly prevent the refrigerant from catching fire outside the room.

As a result, even when R32, which is flammable, is used as a refrigerant for the refrigerant circuit (20), it is possible to prevent the refrigerant concentration from increasing in the air (in other words, the refrigerant is prevented from igniting). Accordingly, serious accidents such as a fire due to refrigerant leakage can be avoided. And, while maintaining safety, it is possible to use R32 of relatively low GWP without destroying the Earth's ozone layer, and it is possible to suppress adverse global environmental effects.

Especially in accordance with the present embodiment, the difference in specific gravity between refrigerant and air is utilized. That is, leaking refrigerant from the refrigerant circuit (20) is discharged through the opening portion (40) by gravity. Therefore, only by the provision of the opening portion (40) in the casing (11), refrigerant can be discharged, and the foregoing accidents due to refrigerant leakage can be avoided assuredly.

Variation of the First Embodiment

In the first embodiment, a substance, whose specific gravity is greater than that of air, is used as the refrigerant, so that the opening portion (40) is formed in the lower portion of the casing (11). On the other hand, if a substance, whose specific gravity is smaller than that of air, such as ammonia, is used as the refrigerant, then the opening portion (40) should be formed in the upper portion of the casing (11). At that time, the opening portion (40) is formed such that it opens to the upstream passageway (36) at a level higher than the lowermost portion of the air suction opening (38). Further, it is more preferable that the opening portion (40) be opened at a level higher than two-thirds of the overall height (h) of the upstream passageway (36) in the height direction thereof (i.e., at a level higher than 2h/3 from the bottom of the upstream passageway (36)).

Second Embodiment of the Invention

A second embodiment of the present invention is different from the first embodiment in that, for example, the arrangement of the air suction opening (38) and the suction duct (18) is changed. Hereinafter, only differences between the present embodiment and the first embodiment will be explained.

Figure 2:
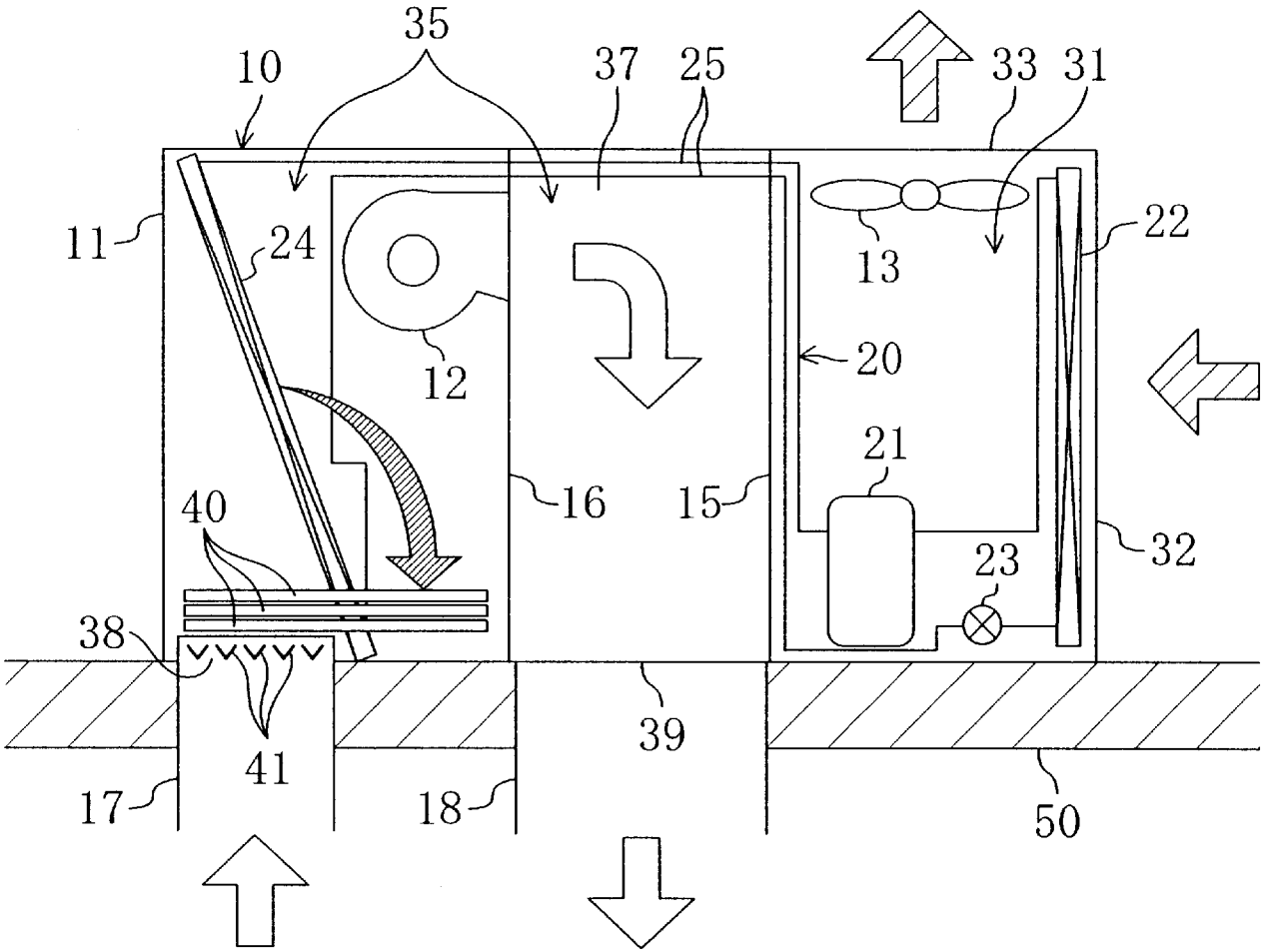
FIG. 2 is a schematic arrangement diagram of an air-conditioning apparatus according to a second embodiment of the present invention, when viewed from a side thereof.

As shown in FIG. 2, the air suction opening (38) is formed in a bottom portion of the casing (11) in the present embodiment. One end of the suction duct (17) is connected to the air suction opening (38). The suction duct (17) is connected such that the one end thereof projects into the upstream passageway (36) of the utilization side air passageway (35). The suction duct (17) opens, at the other end, to an indoor space, as in the first embodiment.

Positioned in the air suction opening (38) are a plurality of baffle plates (41). Each baffle plate (41) is a long narrow plate of vee-shape when viewed from its end face. And, these baffle plates (41) are arranged at equal intervals and positioned all over the air suction opening (38). There is defined a specified space between each baffle plate (41).

In the present embodiment, the slit-like opening portion (40) is formed at the same location as the first embodiment. However, the opening portion (40) of the present embodiment is formed such that it is more oblong than the counterpart of the first embodiment and opens to both the upstream and downstream sides of the evaporator (24) in the upstream passageway (36).

Running Operation

In the present embodiment, as in the first embodiment, cooling operation of the air-conditioning apparatus is performed by bringing the compressor (21), the evaporator fan (12), and the condenser fan (13) into operation. At that time, indoor air drawn through the suction duct (17), after passing through clearances defined among the baffle plates (41), enters the upstream passageway (36). Other operations of the present embodiment are the same as the first embodiment.

If there occurs refrigerant leakage from the refrigerant circuit (20) during cooling operation shutdown, leaking refrigerant travels to the lower area of the upstream passageway (36), as in the first embodiment. Because of this, the leaking refrigerant in the upstream passageway (36), after passing through the opening portion (40) which opens to the lower portion of the upstream passageway (36), is discharged to outside the casing (11).

Further, by virtue of the provision of the baffle plates (41) in the air suction opening (38), the leaking refrigerant is prevented from flowing into the suction duct (17). At that time, there is the possibility that extremely small amounts of refrigerant pass through the clearances defined among the baffle plates (41) and then flow into the room. However, since the refrigerant amount is small, the refrigerant concentration in the room will not reach an ignitible level.

Furthermore, there is another possibility that refrigerant, which has not been discharged from the opening portion (40), will stay in the bottom area of the upstream passageway (36). To cope with this, one end of the suction duct (17) projects into the upstream passageway (36). As a result of such arrangement, the refrigerant lingering in the bottom area of the upstream passageway (36) will not flow into the suction duct (17).

Accordingly, the present embodiment provides the same effects that the first embodiment does.

Third Embodiment of the Invention

A third embodiment of the present invention differs from the first embodiment in that the structure of the utilization side air passageway (35) and the arrangement of the refrigerant circuit (20) in the casing (11) are changed. Hereinafter, only differences between the present embodiment and the first embodiment will be described.

Figure 3:
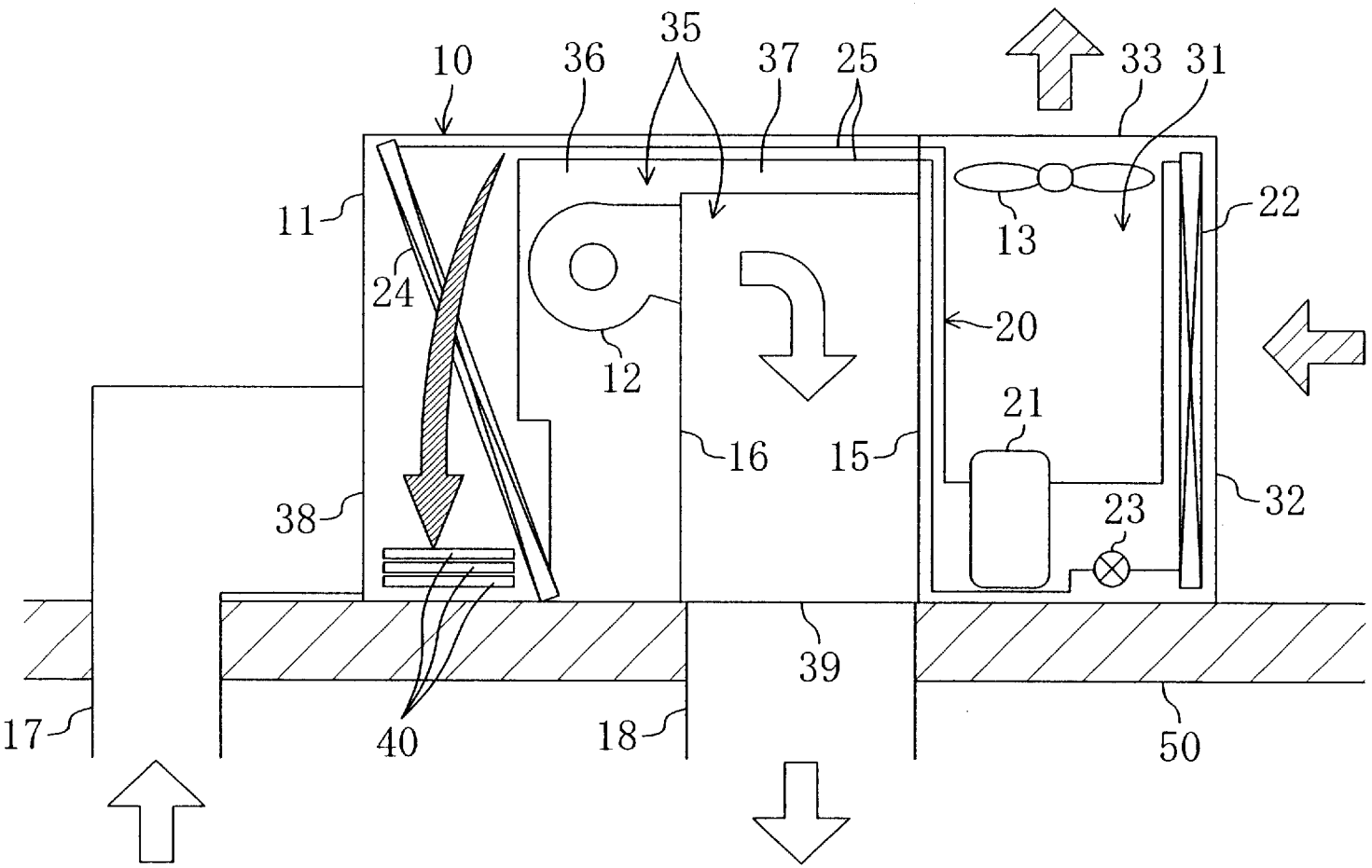
FIG. 3 is a schematic arrangement diagram of an air-conditioning apparatus according to a third embodiment of the present invention, when viewed from a side thereof.

As shown in FIG. 3, in the present embodiment there is made a change in the shape of the bulkhead (16) by which the utilization side air passageway (35) is zoned into the upstream passageway (36) and the downstream passageway (37). As a result of such a change, the upper portion of the upstream passageway (36) extends toward the heat source side air passageway (31). And, the upstream passageway (36) of the present embodiment is partitioned, in a portion thereof, from the heat source side air passageway (31) only by the bulk head (15), which is different from the first embodiment.

The refrigerant circuit (20) of the present embodiment is arranged only in the heat source side air passageway (31) and in the upstream passageway (36). The refrigerant circuit (20) is not arranged in the upstream passageway (37). That is, a refrigerant pipe (25) connecting together the expansion valve (23) and the evaporator (24) and another refrigerant pipe (25) connecting together the compressor (21) and the evaporator (24) pass through the bulkhead (15) from the heat source side air passageway (31), extending to the upstream passageway (36).

Running Operation

In the present embodiment, cooling operation of the air-conditioning apparatus is performed by bringing the compressor (21), the evaporator fan (12), and the condenser fan (13) into operation. Running operations during the cooling in the present embodiment are the same as the first embodiment.

If there occurs refrigerant leakage from the refrigerant circuit (20) during cooling operation shutdown, leaking refrigerant travels to the lower area of the upstream passageway (36), as in the first embodiment. Because of this, the leaking refrigerant in the upstream passageway (36), after passing through the opening portion (40) which opens to the lower portion of the upstream passageway (36), is discharged to outside the casing (11).

As described above, the refrigerant circuit (20) is arranged only in the heat source side air passageway (31) and in the upstream passageway (36). Because of this, the leaking refrigerant will flow neither into the downstream passageway (37) nor into the room through the suction duct (18), unless the evaporator fan (12) is brought into operation. Moreover, even when there occurs refrigerant leakage from the evaporator (24) in the upstream passageway (36) or from the refrigerant pipe (25), leaking refrigerant is discharged, through the opening portion (40), to outside the casing (11), as in the first embodiment. That is, the leaking refrigerant will not flow, through the suction duct (17), into the room.

Accordingly, the present embodiment provides the same effects that the first embodiment does.

Fourth Embodiment of the Invention

A fourth embodiment of the present invention is different from the first embodiment in that, instead of forming the opening portion (40) in the casing (11), components such as a controller (46) which performs specified operations to discharge, upon detection of refrigerant leakage, leaking refrigerant, are provided. Hereinafter, only differences between the present embodiment and the first embodiment will be described.

Figure 4:
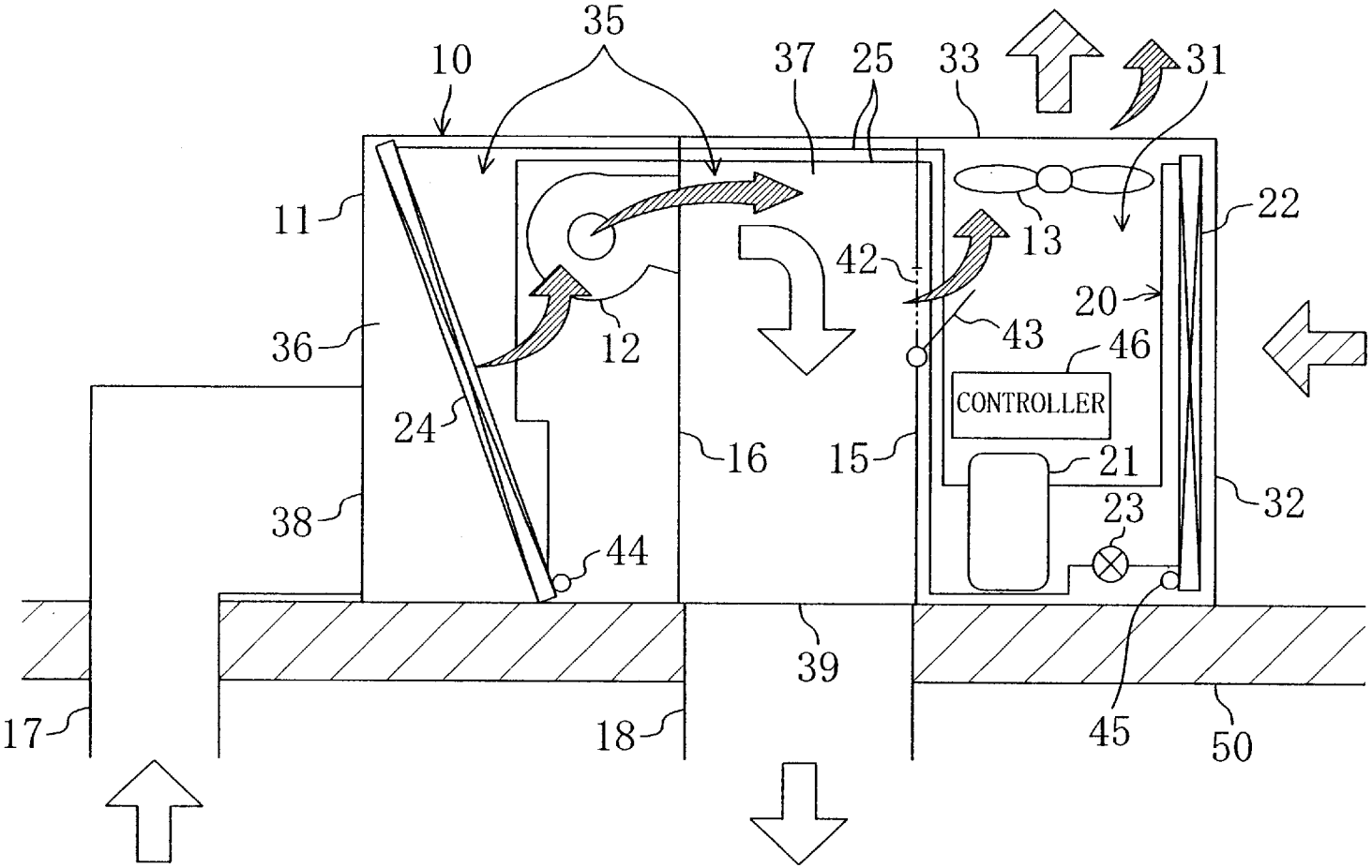
FIG. 4 is a schematic arrangement diagram of an air-conditioning apparatus according to a fourth embodiment of the present invention, when viewed from a side thereof.

As shown in FIG. 4, in the present embodiment a ventilation opening (42) is formed in the bulkhead (15) by which the heat source side air passageway (31) and the utilization side passageway (35) are separated from each other. Formed in the ventilation opening (42) is an opening/closing door (43) for opening and closing the ventilation opening (42). And, when the opening/closing door (43) is opened, the ventilation opening (42) is placed in the opened state, thereby bringing the downstream passageway (37) of the utilization side air passageway (35) and the heat source side air passageway (31) into communication with each other. On the other hand, when the opening/closing door (43) is closed, the ventilation opening (42) is placed in the closed state, thereby disconnecting the downstream passageway (37) of the utilization side air passageway (35) and the heat source side air passageway (31). That is, the opening/closing door (43) constitutes a switching means.

Positioned at a lower portion of the evaporator (24) is a temperature sensor (44) which measures the temperature of the evaporator (24). Further, positioned at a lower portion of the condenser (22) is a temperature sensor (45) which measures the temperature of the condenser (22). Information about temperatures measured by these temperature sensors (44, 45) is fed to the controller (46).

The controller (46) comprises a detection section and a control section (not shown).

Figure 5:
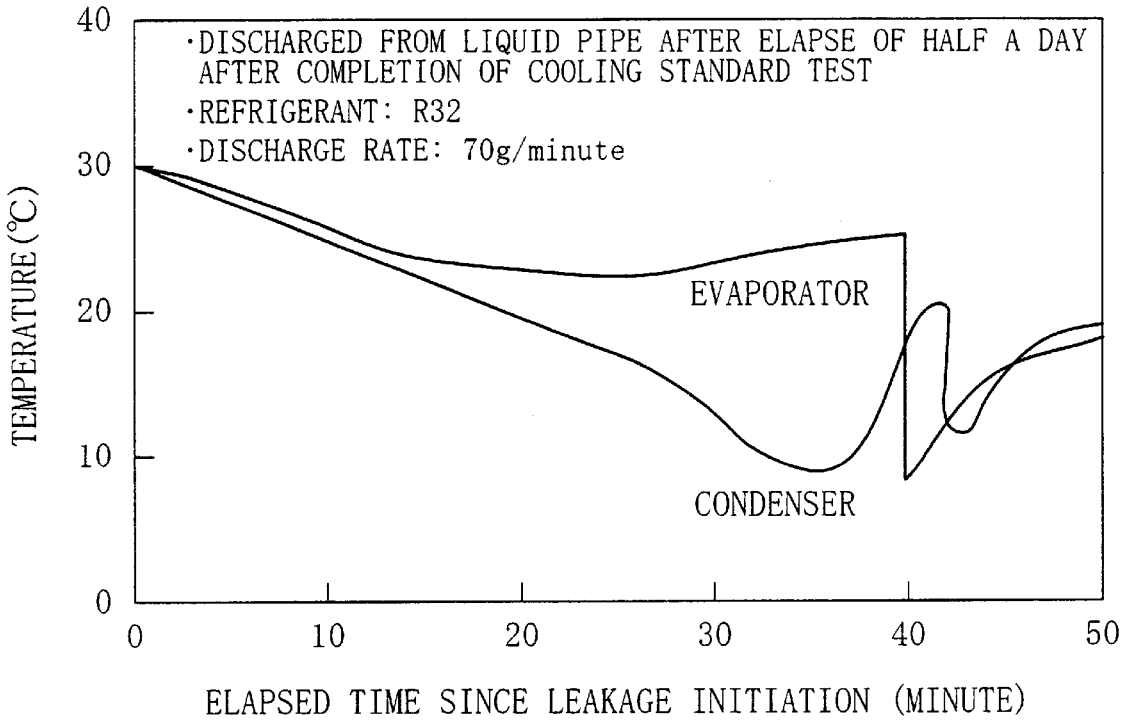
FIG. 5 is a relationship diagram showing, when there occurs refrigerant leakage from a refrigerant circuit, a relationship between the evaporator/condenser temperature and the elapsed time from the time the refrigerant started leaking.

The detection section is so configured as to detect, based on temperatures measured by the temperature sensor (44) of the evaporator (24) and by the temperature sensor (45) of the condenser (22), respectively, the presence or absence of refrigerant leakage from the refrigerant circuit (20). That is, as shown in FIG. 5, if there occurs refrigerant leakage during shutdown, the temperature of the evaporator (24) or the temperature of the condenser (22) will fall. Further, if a given length of time has elapsed since refrigerant leakage occurred, then the temperature of the evaporator (24) or the temperature of the condenser (22) will vary greatly, although the operation is being stopped. The detection section monitors variations in temperatures measured by the temperature sensors (44, 45) for the purpose of detecting the presence or absence of a leak of refrigerant. The detection section constitutes a detection means.

Upon detection of a refrigerant leak by the detection section, the control section performs control so that the opening/closing door (43) is opened to place the ventilation opening (42) in the opened state and, at the same time, the condenser fan (13) is brought into operation. The control section constitutes a control means.

Running Operation

Like the first embodiment, in the present embodiment cooling operation of the air-conditioning apparatus is performed by bringing the compressor (21), the evaporator fan (12), and the condenser fan (13) into operation. During the cooling operation, the opening/closing door (43) is closed, thereby placing the ventilation opening (42) in the closed state.

If there occurs refrigerant leakage from the refrigerant circuit (20) during cooling operation shutdown, the temperature of the evaporator (24) or the temperature of the condenser (22) will undergo a variation, as described above. The detection section of the controller (46) detects, based on temperatures measured by the temperature sensors (44, 45), refrigerant leakage. Upon detection of the refrigerant leakage by the detection section, the control section performs control so that the opening/closing door (43) is opened and, at the same time, the condenser fan (13) is brought into operation.

In such a state, refrigerant, which has leaked from the refrigerant circuit (20) into the utilization side air passageway (35), is drawn into the condenser fan (13), then enters the heat source side air passageway (31) through the ventilation opening (42), and thereafter is discharged from the outside air outlet (33) to outside the casing (11). At that time, refrigerant in the upstream passageway (36) enters the downstream passageway (37) through the evaporator fan (12) and then is discharged through the heat source side air passageway (31), together with the refrigerant in the downstream passageway (37). Accordingly, even when there occurs refrigerant leakage, leaking refrigerant will neither flow into the room nor stay within the casing (11).

Effects of the Fourth Embodiment

In accordance with the fourth embodiment, the following same effects as the first embodiment are obtained, that is, leaking refrigerant from the refrigerant circuit (20) is prevented from flowing into the room and fire hazard et cetera can be avoided by discharging the leaking refrigerant to outside the casing (11). Further, in the present embodiment, it is arranged such that the condenser fan (13) is brought into operation for forcedly discharging leaking refrigerant out of the casing (11). Therefore, the discharging of leaking refrigerant from the casing (11) is assuredly carried out.

Fifth Embodiment of the Invention

A fifth embodiment of the present invention differs from the first embodiment in that components such as a controller (46) which performs, upon detection of refrigerant leakage, specified operations for discharging leaking refrigerant, are provided. Further, in the present embodiment, propane which is flammable is used as a refrigerant for the refrigerant circuit (20). Flammable refrigerants, such as butane, isobutane, and the like, may be used as a refrigerant for the refrigerant circuit (20). Hereinafter, only differences between the present embodiment and the first embodiment will be described.

Figure 6:
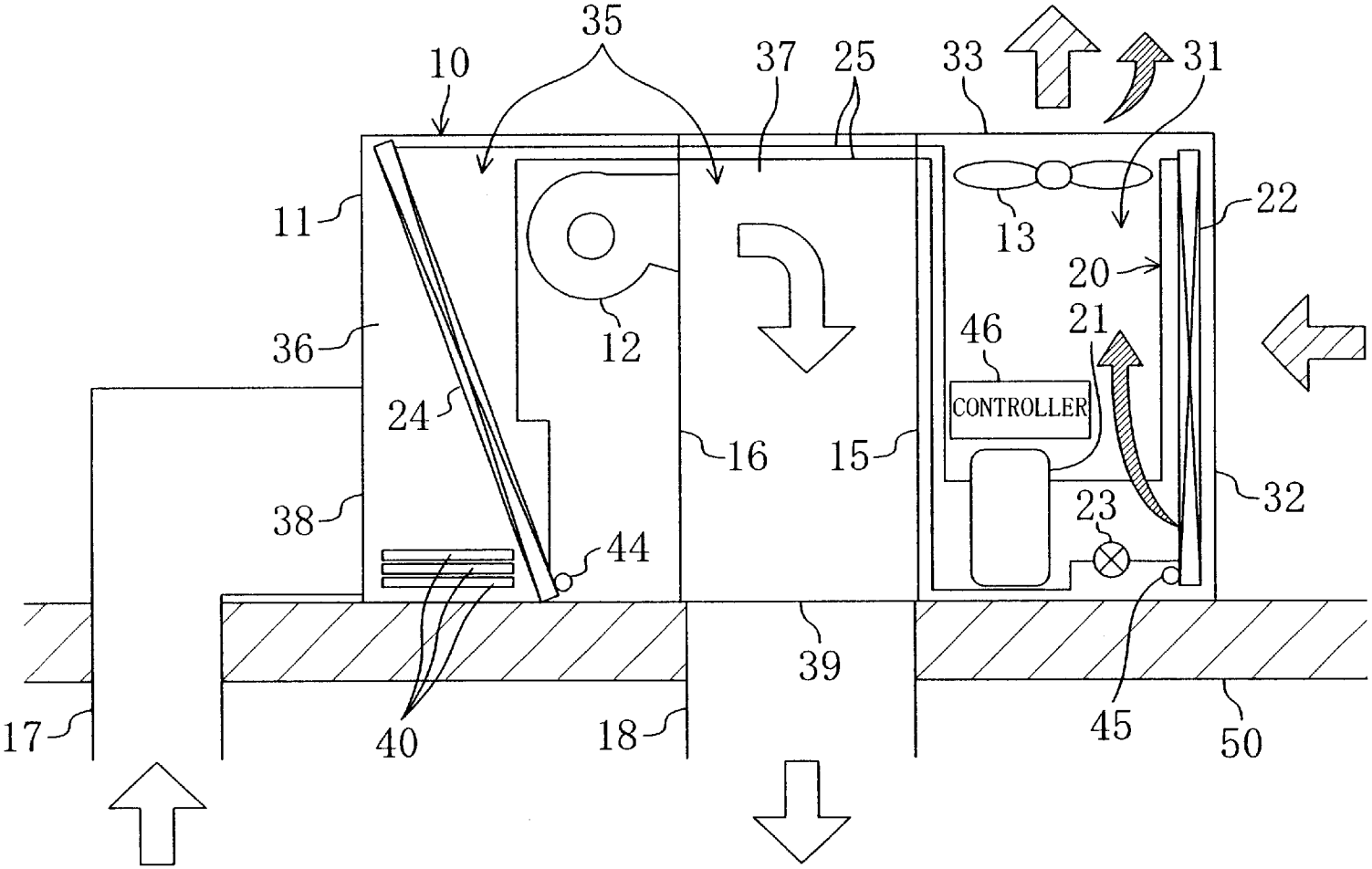
FIG. 6 is a schematic arrangement diagram of an air-conditioning apparatus according to a fifth embodiment of the present invention, when viewed from a side thereof.

As shown in FIG. 6, in the present embodiment a temperature sensor (44) which measures the temperature of the evaporator (24) is positioned at a lower portion of the evaporator (24). Further, positioned at a lower portion of the condenser (22) is a temperature sensor (45) which measures the temperature of the condenser (22). Information about temperatures measured by these temperature sensors (44, 45) is fed to the controller (46).

The controller (46) comprises a detection section and a control section (not shown). As in the fourth embodiment, the detection section is so configured as to detect, based on temperatures measured by the temperature sensor (44) of the evaporator (24) and by the temperature sensor (45) of the condenser (22), respectively, the presence or absence of a refrigerant leak from the refrigerant circuit (20). The detection section constitutes a detection means. Upon detection of a refrigerant leak by the detection section, the control section performs control so that the condenser fan (13) is brought into operation. The control section constitutes a control means.

Running Operation

In the present embodiment, cooling operation of the air-conditioning apparatus is performed by bringing the compressor (21), the evaporator fan (12), and the condenser fan (13) into operation. Running operations during the cooling in the present embodiment are the same as the first embodiment.

If there occurs refrigerant leakage during cooling operation shutdown, leaking refrigerant travels to the lower area of the upstream passageway (36), as in the first embodiment. Because of this, the leaking refrigerant in the upstream passageway (36) is discharged, through the opening portion (40) which opens to the lower portion of the upstream passageway (36), to outside the casing (11). Further, when the detection section detects a refrigerant leak, the condenser fan (13) is brought into operation. And, the refrigerant, which has leaked from the refrigerant circuit (20) and flowed into the heat source side air passageway (31), is forcedly discharged to outside the casing (11).

Effects of the Fifth Embodiment

Like the first embodiment, in accordance with the present embodiment it is possible to prevent leaking refrigerant from the refrigerant circuit (20) from flowing into the room from the utilization side air passageway (35) and, in addition, the leaking refrigerant is discharged from the opening portion (40) for preventing it from staying in the utilization side air passageway (35). This assuredly avoids fire hazard et cetera caused when leaking refrigerant catches fire.

Propane, used as a refrigerant for the refrigerant circuit (20) in the present embodiment, is highly flammable and ignites when its concentration in the air reaches a level of 2.1%. Further, since propane is highly flammable, there is the possibility that it is ignited by a slight spark at a relay contact provided in an electric system of the air-conditioning apparatus. However, in the present embodiment, upon detection of refrigerant leakage, leaking refrigerant can forcedly be purged also from the heat source side air passageway (31). This assuredly prevents leaking refrigerant in the heat source side air passageway (31) from staying therein. Accordingly, even when propane, which is highly flammable, is used as the refrigerant, it is possible to satisfactory secure safety.

Other Embodiments of the Invention

In each of the first, second, third, and fifth embodiments, the opening portion (40) is formed in the casing (11) and refrigerant in the utilization side air passageway (35) is automatically discharged through the opening portion (40). Alternatively, an arrangement may be made in which a fan of small capacity is provided in the utilization side air passageway (35) as a blower means and refrigerant in the utilization side air passageway (35) is forcedly purged from the opening portion (40) by the fan. In this case, it is possible to discharge leaking refrigerant by bringing the fan into operation even during cooling operation.

Further, in each of the fourth and fifth embodiments, the presence or absence of a refrigerant leak is detected based on temperatures measured by the temperature sensor (44) of the evaporator (24) and the temperature sensor (45) of the condenser (22). Instead of using these temperature sensors, a gas sensor making utilization of sensor surface adsorption and chemical change may be employed for detecting the presence or absence of a refrigerant leak.

INDUSTRIAL APPLICABILITY

As described above, the present invention provides an air-conditioning apparatus useful for room cooling and heating. Particularly, the present invention is applicable to air-conditioning apparatus using as its refrigerant a substance which may cause hazard when leaked.

What is claimed is:

1. An air-conditioning apparatus comprising an outdoor casing (11) for housing a refrigerant circuit (20) charged with refrigerant, wherein a utilization side air passageway (35) in which a utilization side heat exchanger (24) for said refrigerant circuit (20) is disposed and a heat source side air passageway (31) in which a heat source side heat exchanger (22) for said refrigerant circuit (20) is disposed are formed in said casing (11), said passageways (35) and (31) being in communication with the inside and the outside of a room, respectively, wherein an opening portion (40) allowing said utilization side air passageway (35) to communicate with the outside of said casing (11) is formed in said casing (11), wherein said refrigerant of said refrigerant circuit 10 (20) comprises a substance whose atmospheric specific gravity is greater than that of air;

wherein an air suction opening (38) is formed in a lateral portion of said casing (11), thereby allowing said utilization side air passageway (35) to communicate with the inside of said room through a duct (17) connected to said air suction opening (38); and wherein said opening portion (40) is so formed as to open to said utilization side air passageway (35) at a level lower than the uppermost portion of said air suction opening (38).

2. The air-conditioning apparatus of claim 1, wherein said casing (11) is placed on a rooftop.

3. An air-conditioning apparatus comprising an outdoor casing (11) for housing a refrigerant circuit (20) charged with refrigerant, wherein a utilization side air passageway (35) in which a utilization side heat exchanger (24) for said refrigerant circuit (20) is disposed and a heat source side air passageway (31) in which a heat source side heat exchanger (22) for said refrigerant circuit (20) is disposed are formed in said casing (11), said passageways (35) and (31) being in communication with the inside and the outside of a room, respectively, wherein an opening portion (40) allowing said utilization side air passageway (35) to communicate with the outside of said casing (11) is formed in said casing (11), wherein said refrigerant of said refrigerant circuit (20) comprises a substance whose atmospheric specific gravity is smaller than that of air;

wherein an air suction opening (38) is formed in a lateral portion of said casing (11), thereby allowing said utilization side air passageway (35) to communicate with the inside of said room through a duct (17) connected to said air suction opening (38); and wherein said opening portion (40) is formed so as to open to said utilization side air passageway (35) at a level higher than the lowermost portion of said air suction opening (38).

4. An air-conditioning apparatus comprising an outdoor casing (11) for housing a refrigerant circuit (20) charged with refrigerant, wherein a utilization side air passageway (35) in which a utilization side heat exchanger (24) for said refrigerant circuit (20) is disposed and a heat source side air passageway (31) in which a heat source side heat exchanger (22) for said refrigerant circuit (20) is disposed are formed in said casing (11), said passageways (35) and (31) being in communication with the inside and the outside of a room, respectively, wherein an opening portion (40) allowing said utilization side air passageway (35) to communicate with the outside of said casing (11) is formed in said casing (11), wherein an air suction opening (38) is formed in said casing (11), thereby allowing said utilization side air passageway (35) to communicate with the inside of said room through a duct (17) connected to said air suction opening (38); and wherein a baffle plate (41) is positioned in said air suction opening (38) so that refrigerant leaking from said refrigerant circuit (20) into said utilization side air passageway (35) is prevented from flowing into the inside 25 of said room.

5. An air-conditioning apparatus comprising an outdoor casing (11) for housing a refrigerant circuit (20) charged with refrigerant, wherein a utilization side air passageway (35) in which a utilization side heat exchanger (24) for said refrigerant circuit (20) is disposed and a heat source side air passageway (31) in which a heat source side heat exchanger (22) for said refrigerant circuit (20) is disposed are formed in said casing (11), said passageways (35) and (31) being in communication with the inside and the outside of a room, respectively, wherein an opening portion (40) allowing said utilization side air passageway (35) to communicate with the outside of said casing (11) is formed in said casing (11), wherein said refrigerant of said refrigerant circuit (20) comprises a substance whose atmospheric specific gravity is greater than that of air;

wherein said utilization side air passageway (35) communicates with the inside of said room through a duct (17) connected to a bottom portion of said casing (11); and wherein said duct (17) is connected to said casing (11) so that one end of said duct (17) projects into said utilization side air passageway (35).

6. An air-conditioning apparatus comprising an outdoor casing (11) for housing a refrigerant circuit (20) charged with refrigerant, wherein a utilization side air passageway (35) in which a utilization side heat exchanger (24) for said refrigerant circuit (20) is disposed and a heat source side air passageway (31) in which a heat source side heat exchanger (22) for said refrigerant circuit (20) is disposed are formed in said casing (11), said passageways (35) and (31) being in communication with the inside and the outside of a room, respectively, wherein an opening portion (40) allowing said utilization side air passageway (35) to communicate with the outside of said casing (11) is formed in said casing (11), wherein said utilization side air passageway (35) in which utilization side blower means (12) is disposed is zoned into an upstream passageway (36) on the upstream side of said utilization side blower means (12) and a downstream passageway (37) on the downstream side of said utilization side blower means (12);

wherein said refrigerant circuit (20) is so arranged in said upstream passageway (36) and in said heat source side air passageway (31) as to detour said downstream passageway (37); and wherein said opening portion (40) is formed so as to allow said upstream passageway (36) of said utilization side air passageway (35) to communicate with the outside of said casing (11).

7. An air-conditioning apparatus comprising an outdoor casing (11) for housing a refrigerant circuit (20) charged with flammable refrigerant, wherein a utilization side air passageway (35) in which a utilization side heat exchanger (24) for said refrigerant circuit (20) is disposed and a heat source side air passageway (31) in which a heat source side heat exchanger (22) for said refrigerant circuit (20) is disposed are formed in said casing (11), said passageways (35) and (31) being in communication with the inside and the outside of a room, respectively;

wherein said air-conditioning apparatus further comprises:

heat source side blower means (13) disposed in said heat source side air passageway (31);

detection means for detecting the presence or absence of a refrigerant leak from said refrigerant circuit (20);

switching means for performing switching so that the connection of said utilization side air passageway (35) and said heat source side air passageway (31) switches between a communicated state and a disconnected state; and control means for performing control so that, upon detection of a refrigerant leak by said detection means, said utilization side air passageway (35) are brought into communication with each other and said heat source side blower means (13) is brought into operation.

8. An air-conditioning apparatus comprising an outdoor casing (11) for housing a refrigerant circuit (20) charged with refrigerant, wherein a utilization side air passageway (35) in which a utilization side heat exchanger (24) for said refrigerant circuit (20) is disposed and a heat source side air passageway (31) in which a heat source side heat exchanger (22) for said refrigerant circuit (20) is disposed are formed in said casing (11), said passageways (35) and (31) being in communication with the inside and the outside of a room, respectively; and wherein said air-conditioning apparatus further comprises:

heat source side blower means (13) disposed in said heat source side air passageway (31);

detection means for detecting the presence or absence of a refrigerant leak from said refrigerant circuit (20); and control means for performing control so that, upon detection of a refrigerant leak by said detection means, said heat source side blower means (13) is brought into operation.

9. An air-conditioning apparatus including a refrigerant circuit (20) charged with refrigerant, wherein a utilization side air passageway (35) in which 5 a utilization side heat exchanger (24) for said refrigerant circuit (20) is disposed is divided into zones, said utilization side air passageway (35) being in communication with the inside of a room, wherein an opening portion (40), which opens to said 10 utilization side air passageway (35) to allow said utilization side air passageway (35) to communicate with the outside of said room, is formed so that refrigerant leaking from said refrigerant circuit (20) into said utilization side air passageway (35) is at least discharged from said opening portion (40) to outside said room, wherein said refrigerant of said refrigerant circuit (20) comprises a substance whose atmospheric specific gravity is smaller than that of air; and wherein said opening portion (40) is formed so as to open to an upper portion of said utilization side air passageway (35).

10. An air-conditioning apparatus comprising an outdoor casing (11) for housing a refrigerant circuit (20) charged with refrigerant, wherein a utilization side air passageway (35) in which a utilization side heat exchanger (24) for said refrigerant circuit (20) is disposed and a heat source side air passageway (31) in which a heat source side heat exchanger (22) for said refrigerant circuit (20) is disposed are formed in said casing (11), said passageways (35) and (31) being in communication with the inside and the outside of a room, respectively, wherein an opening portion (40) allowing said utilization side air passageway (35) to communicate with the outside of said casing (11) is formed in said casing (11), wherein said refrigerant of said refrigerant circuit (20) comprises a substance whose atmospheric specific gravity is smaller than that of air, and wherein said opening portion (40) is formed so as to open to an upper portion of said utilization side air passageway (35).

11. The air-conditioning apparatus of claims 9 or 10, wherein said opening portion (40) is so formed as to open at a level higher than two-thirds of the overall height of said utilization side air passageway (35) from the bottom of said utilization side air passageway (35).

12. An air-conditioning apparatus including a refrigerant circuit (20) charged with refrigerant, wherein a utilization side air passageway (35) in which 5 a utilization side heat exchanger (24) for said refrigerant circuit (20) is disposed is divided into zones, said utilization side air passageway (35) being in communication with the inside of a room;

wherein an opening portion (40), which opens to said 10 utilization side air passageway (35) to allow said utilization side air passageway (35) to communicate with the outside of said room, is formed so that refrigerant leaking from said refrigerant circuit (20) into said utilization side air passageway (35) is at least discharged from said opening portion (40) to outside said room, and wherein said opening portion (40) is formed so as to open to both upstream and downstream, sides of said utilization side heat exchanger (24) in said utilization side air passageway (35).

13. An air-conditioning apparatus comprising an outdoor casing (11) for housing a refrigerant circuit (20) charged with refrigerant, wherein a utilization side air passageway (35) in which a utilization side heat exchanger (24) for said refrigerant circuit (20) is disposed and a heat source side air passageway (31) in which a heat source side heat exchanger (22) for said refrigerant circuit (20) is disposed are formed in said casing (11), said passageways (35) and (31) being in communication with the inside and the outside of a room, respectively;

wherein an opening portion (40) allowing said utilization side air passageway (35) to communicate with the outside of said casing (11) is formed in said casing (11), and wherein said opening portion (40) is formed so as to open to both upstream and downstream, sides of said utilization side heat exchanger (24) in said utilization side air passageway (35).

14. The air-conditioning apparatus of any one of claims 1, 3, 4–6, 7 or 9–13, wherein said refrigerant of said refrigerant circuit (20) comprises a flammable substance.

* * * * *

UNITED STATES PATENT AND TRADEMARK OFFICE

CERTIFICATE OF CORRECTION

PATENT NO. : 6,536,225 B1
DATED : March 23, 2003
INVENTOR(S) : Ryuzaburo Yajima

It is certified that error appears in the above-identified patent and that said Letters Patent is hereby corrected as shown below:

Title page,
Item [54], Title, delete "AIR CONDITIONER" and add -- AIR-CONDITIONING APPARATUS --.
Item [22], should read:
[22] PCT Filed: March 1, 2000
Insert the following items:
-- [86] PCT No.: PCT/00JP/01212
§371 (c) (1),
(2), (4) Date: Aug. 30, 2001

[87] PCT Pub. No.: WO00/52394
PCT Pub. Date: Sept. 8, 2000 --

Column 19,
Line 35, delete "flammable" before "refrigerant"
Line 58, after "(35)" insert -- and said heat source side air passageway (31) --
Line 64, before "refrigerant" insert -- flammable --

Signed and Sealed this

Fourth Day of November, 2003

JAMES E. ROGAN
*Director of the United States Patent and Trademark Office*